United States Patent [19]

Schurman

[11] 4,244,612

[45] Jan. 13, 1981

[54] MOLDED PLASTIC SNAP-ON LATCH FOR PLASTIC RECEPTACLE

[76] Inventor: Peter T. Schurman, 21 Cassway Rd., Woodbridge, Conn. 06525

[21] Appl. No.: 16,122

[22] Filed: Mar. 1, 1979

[51] Int. Cl.[2] ..... E05C 19/06

[52] U.S. Cl. ..... 292/249; 292/DIG. 38; 292/DIG. 53

[58] Field of Search ..... 292/80, 87, 246–250, 292/DIG. 38, DIG. 53

[56] References Cited

U.S. PATENT DOCUMENTS 3,544,146 12/1970 Asenbauer ..... 292/87

3,730,576 5/1973 Schurman ..... 292/87 X

*Primary Examiner*—Richard E. Moore

[57] ABSTRACT

A molded plastic latch structure for molded two-part receptacles comprising a base and a cover forming a closure for various types of articles, wherein the latch structure includes opposed mounting lug and latching post members adjacent the confronting edges of the receptacle base and cover, and a latching buckle adapted to be secured to the lug member against accidental detachment from the base or cover, wherein the buckle incorporates a flexible bail for releasable engagement with the post member in the closed condition of the receptacle to maintain it in such condition.

7 Claims, 10 Drawing Figures

MOLDED PLASTIC SNAP-ON LATCH FOR PLASTIC RECEPTACLE

BACKGROUND OF THE INVENTION

This invention is directed generally to latch constructions for securing separable base and cover members of a receptacle or container in closed condition, and is more particularly directed to molded plastic latch constructions for molded plastic receptacles. The invention constitutes an improvement over the latch construction shown in my prior U.S. Pat. No. 3,730,576.

As discussed in the foregoing patent, blow molding of separate receptacle base and cover members provides an effective and economical way of fabricating a separable closure for a variety of articles. Particularly where the molded members are of the conventional double-wall construction, the blow molding technique provides an excellent way of matching the configuration of the receptacle base and cover to the particular shape of the article or articles to be contained. The double-wall construction facilitates receptacle design of suitably smooth or regular exterior surface, yet may be configured internally to produce retaining wells or abutments to accommodate the contour of the article contained, so as to securely restrain it against movement within the receptacle when closed. This is of great advantage for packaging tools, test instruments, electronic equipment and the like which are subject to damage during storage and transport. Double-wall constructions also provide a shock resistant cushion against damage to contained articles if the receptacle is dropped or is exposed to sudden contact with surrounding objects. The trade is familiar with these and other advantages of double-walled blow molded receptacles, but experience has indicated the desirability of further improvement in the latch constructions which have previously been used to maintain the cover and base members in closed condition. A need for improved latch constructions is indicated in not only maintaining the economical compatibility of the previous constructions with blow molded containers, but in giving greater assurance against accidental detachment or failure under load. In the latch construction disclosed in my aforesaid patent, the means for securing the latching buckle to the receptacle employs a latch anchor bar on the container and a continuous slot in the buckle, with interference nibs along opposite sides of the slot which snap over the head of the anchor bar. Resilient compressibility of the plastic material of the head of the anchor bar and nibs of the buckle is relied upon to permit the attachment to be made. But this inherent resiliency of the plastic also allows for detachment to occur, so a compromise must be made in determining the degree of interference to permit attachment yet resist detachment.

It is accordingly an object of this invention to provide an improved latch construction of the type and for the purpose above indicated, it being particularly desired to provide a latch which is more secure against accidental detachment, particularly under stress, than has been available heretofore but which is nevertheless simple and economical to make, and is also easily assembled to the container or receptacle which it serves to keep in closed condition. These and other objects will become apparent from the following description of a preferred latch construction incorporating the characterizing features of this invention, as embodied in a double wall, blow molded receptacle shown in the accompanying drawings.

DESCRIPTION OF THE ILLUSTRATED EMBODIMENT

Figure 1:
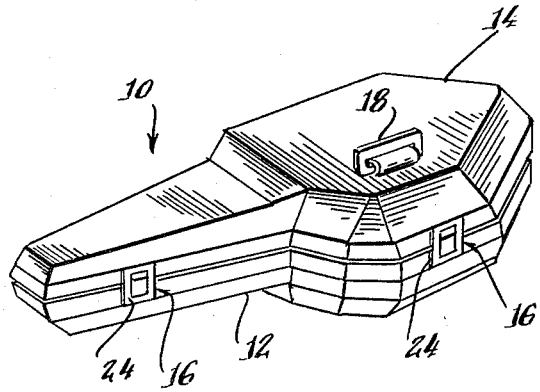
FIGS. 1 and 2 are perspective views of a typical blow molded double-wall receptacle incorporating several improved latch structures of the present invention, the receptacle being illustrated in closed and open conditions in the respective views.
Figure 2:
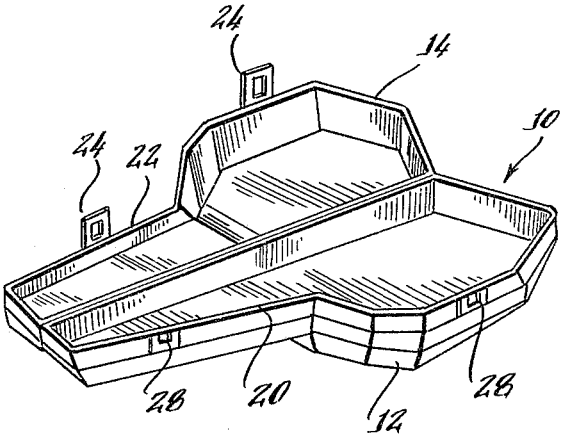

The improved latch structure of the invention is illustrated in FIGS. 1 and 2 where it is shown as incorporated in a blow molded double-wall carrying case 10 adapted for enclosing a chain saw, for example. Case 10 is partible along a medial plane, being composed of a base member 12 with a cover member 14 which are complementary and whose confronting edges coincide in the medial plane. Base 12 and cover 14 are hinged along a rear edge, visible in FIG. 2, to permit the case to be swung open so that the members are disposed in side-by-side relation to give full access to the interior of the case for removal and replacement of the chain saw. Case 10 when closed is maintained in such position by a pair of the latch structures indicated generally at 16 which bridge across the unhinged edges at spaced points on the front side of the case. In closed and latched condition, case 10 can be picked up by means of a handle 18 secured in the upper face of cover 14 to facilitate carrying.

Figure 3:
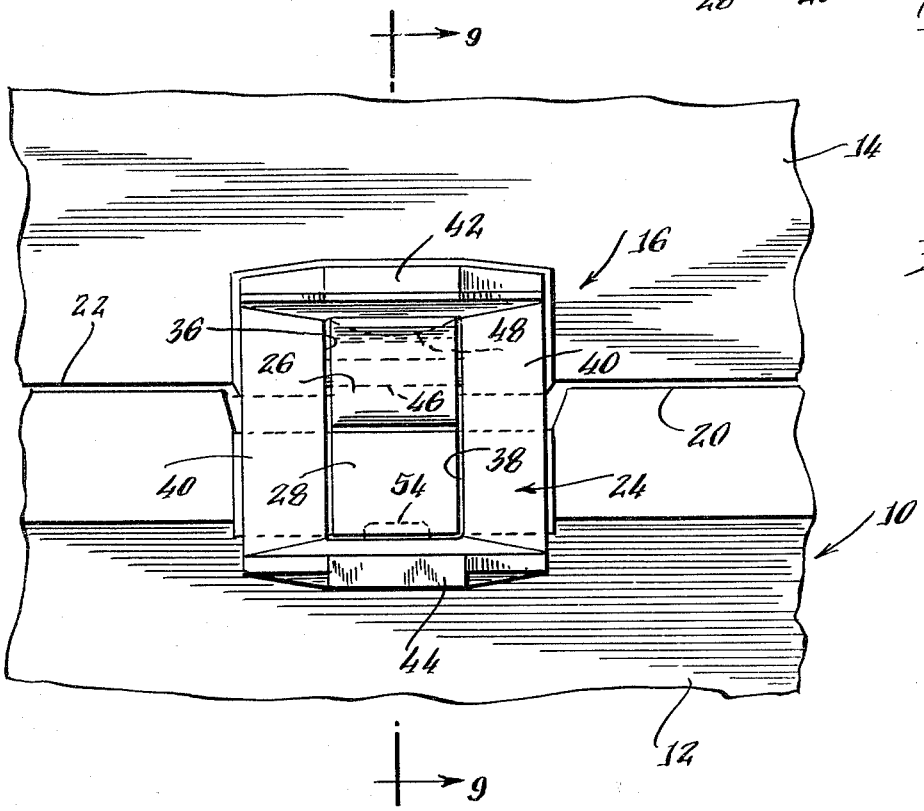
FIG. 3 is an enlarged front view of a portion of the receptacle seen in FIG. 1, showing one of the latches in more detail.

FIG. 3 illustrates one of latch structures 16 in greater detail. As there seen, latch structure 16 bridges across the confronting edges 20, 22 of base and cover members 12 and 14, respectively. Latch structure 16 is comprised of a buckle 24 which is mounted in this case on a boss or mounting lug 26 molded integrally adjacent the confronting edge 22 of cover 14. Buckle 24 also makes detachable engagement with a latching post 28 which in this case is molded integrally adjacent confronting edge 20 of base 12.

Figure 4:
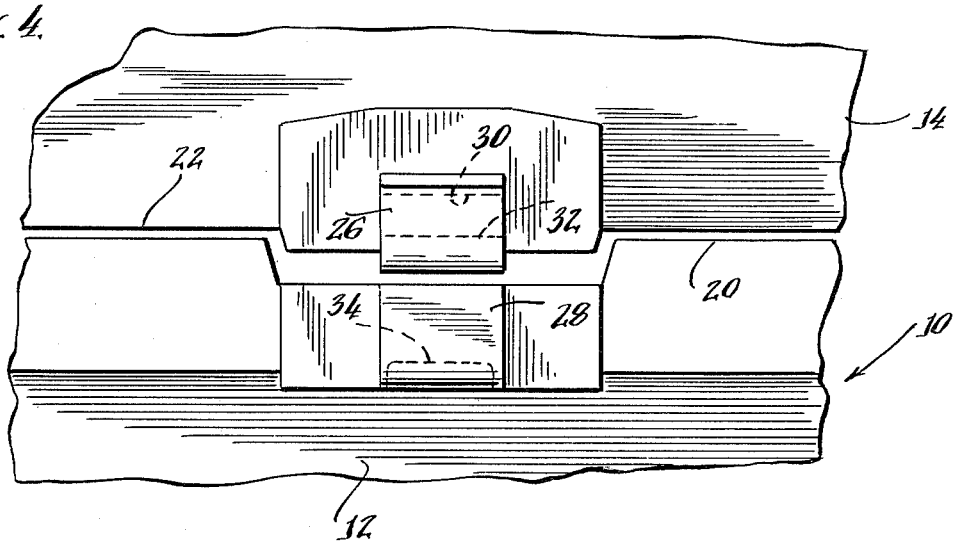
FIG. 4 is a view similar to that of FIG. 3 but omitting the latch buckle.
Figure 6:
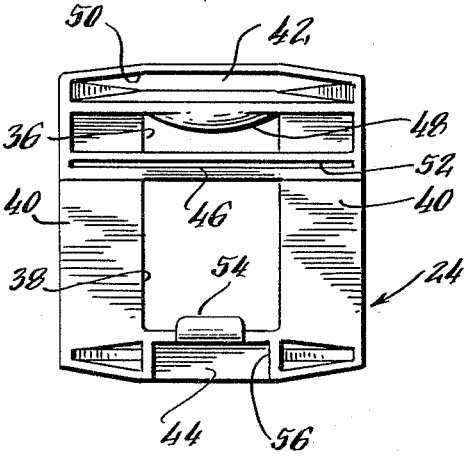
FIG. 6 is a plan view of the back face of a latch buckle.
Figure 7:
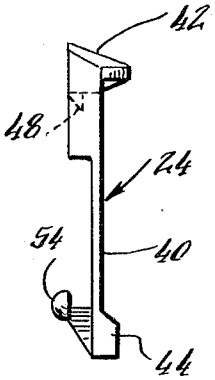
FIG. 7 is a side elevational view of a latch buckle.
Figure 9:
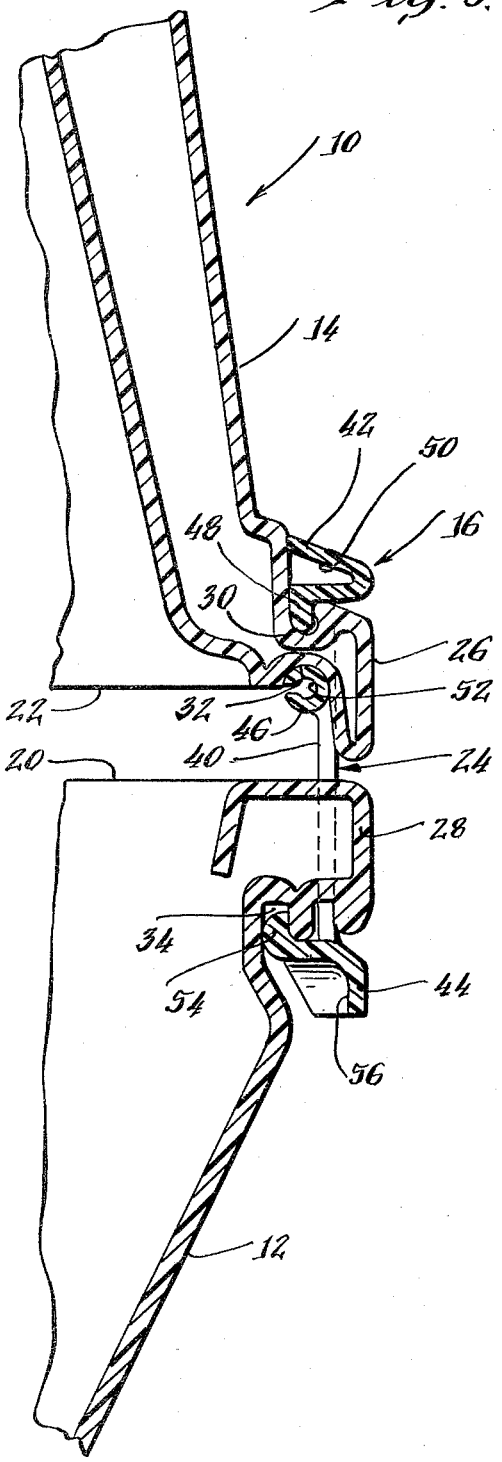
FIG. 9 is a fragmentary cross sectional view taken on line 9—9 of FIG. 3, showing the positioning of the parts in the closed, latched, condition of the receptacle.
Figure 10:
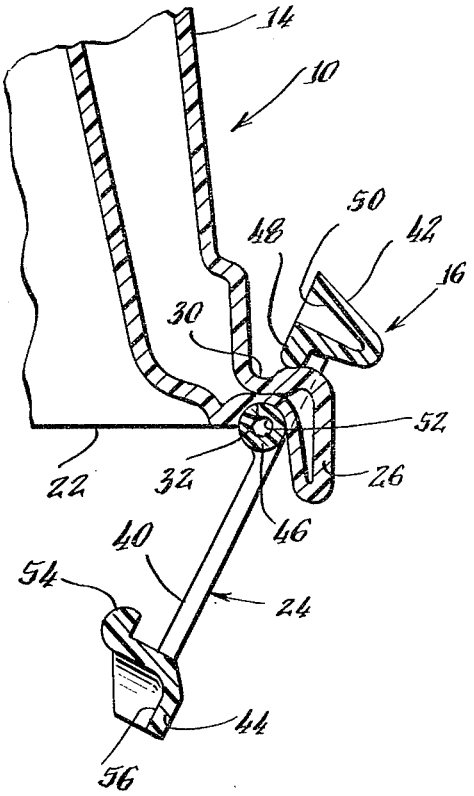
FIG. 10 is a fragmentary sectional view illustrating the manner of assembling the latch buckle to its supporting container member.

Further details of the mounting lug and latching post are illustrated in FIG. 4 which is similar to that of FIG. 3 but from which the latching buckle has been omitted. Lug 26 protrudes outwardly of the face of cover 14, as best seen in FIGS. 9 and 10, and is provided with cooperating recesses 30, 32 on the upper and lower surfaces of lug 26, extending parallel to confronting edge 22. Lug 26 is formed to provide a cam surface 32, again as best seen in FIGS. 9 and 10, sloping away from confronting edge 22. Recesses 30 and 32 are adapted to receive and retain cooperating members of buckle 24, more fully described hereinafter, when the buckle is assembled to cover 14, and cam surface 32 facilitates such assembly of the buckle to the cover, as will also be further described hereinafter.

Latching post 28 which complements mounting lug 26 of latch construction 16, also projects forwardly from the corresponding confronting edge 20 of base 12, terminating flush with the forward projection of lug 26. See FIG. 9. Latching post 28 is formed on its under surface (i.e., the surface remote from confronting edge 20) with a double step recess 34 providing a latching detent which is engageable by a bail portion of buckle 24, as more fully described presently, when the buckle is pressed toward the receptacle.

Latching buckle 24 is illustrated more fully in FIGS. 5 through 8. Buckle 24 is of generally flat, rectangular form having a mounting lug receiving aperture 36 and a latch post receiving aperture 38, each defined by a pair of spaced parallel side rails 40, by parallel bridging bars 42 or 44 at opposite ends of rails 40, and by an intermediate bar 46.

Mounting lug receiving aperture 36 is of relatively narrow, generally rectangular form whose longer sides are formed by intermediate bar 46 and end bar 42. In width, aperture 36 is substantially less than the height or thickness of outer camming face of lug 26, but is substantially equal to the thickness of the lug between recesses 30 and 32. Bar 42 is provided with an arcuate tab 48 which extends into aperture 36 in the plane thereof such that the gap in aperture 36 at the peak of tab 48 is slightly less than the thickness of lug 26 between recesses 30 and 32. Each of bars 42, 46 is here shown as being recessed or slotted on its undersurface (see FIG. 6) to provide lengthwise slots 50, 52, respectively, to impart resilience to these members transversely of their length in the plane of the buckle. Depending on dimensional design considerations in the several parts of the buckle, the recessing of the undersurface at these points and particularly at the intermediate bar 46 is optional. The recessing serves primarily to facilitate assembly of the buckle to mounting lug 26, as is illustrated more particularly in FIG. 10. In other words, the normal distance between them (i.e. the width of aperture 36) can be made substantially less than the outer face dimension of lug 26 and even slightly less than the distance between recesses 30 and 32 as mentioned above, so that buckle 24 is securely retained on lug 26 after it has been snapped into position on it. The arrangement for effecting such assembly of the buckle to lug 26 is illustrated more specifically in FIG. 10, which shows how the buckle is initially manipulated to position intermediate bar 46 under the lower face of lug 26 with bar 46 seated in recess 30; after which the upper end of buckle 24 is then pressed inwardly toward the cover member, causing tab 48 on bar 42 to be cammed over the sloping cam surface 32 of lug 26 until tab 48 can drop into upper recess 30 behind lug 26, thereby securely locking buckle 24 onto lug 26. The arcuate formation of tab 48 permits some rocking of the buckle during assembly, further facilitating assembly, yet tab 48 then increases resistance to detachment of the mounted buckle.

Figure 5:
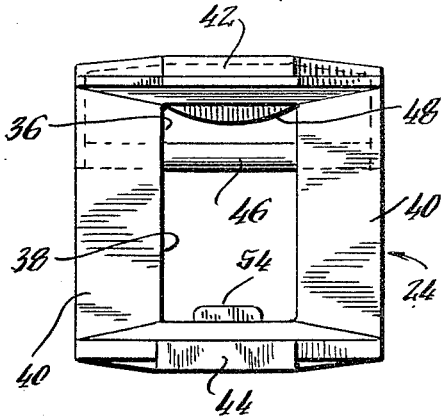
FIG. 5 is a plan view of the front face of a latch buckle.
Figure 8:
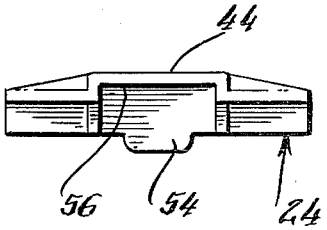
FIG. 8 is an elevational view of the front edge of a latch buckle.

As seen more particularly in FIGS. 5 and 10, the latch post receiving aperture 38 of buckle 24 is defined at its upper end by bridging bar 46 and at its lower end by bar 44, while the portions of side rails 40 defining the lateral sides of the buckle are of reduced thickness, constituting flexible straps acting with bar 44 to form a bail. End bar 44 is provided on its undersurface with a pawl 54 adapted to make a resilient interference engagement with the double step recess 34 on the undersurface of latching post 28 when the buckle is in latched position on the container. See particularly FIG. 9. The double step of recess 34 provides extra latching security. A finger tab 56 at the underface of bar 44 gives an access grip for unlatching the bail of buckle 24 from latching post 28 when the receptacle is to be opened.

What is claimed is:

1. A latch structure for plastic receptacles having base and cover closure members separable along a parting line to form confronting edges in the closed condition of said receptacle, said latch structure comprising a mounting lug on one of said members adjacent a confronting edge thereof, said mounting lug being formed to provide cooperating recesses on opposite surfaces extending parallel to and closely adjacent said confronting edge, and a forwardly projecting camming surface connecting said recesses and sloping away from said confronting edge;

a latching post on the other of said base or cover members, adjacent the confronting edge of said other member and complementing said mounting lug, said latching post having a detent on its face remote from said confronting edge; and a plastic buckle adapted to be mounted on said mounting lug for engagable and disengagable cooperation with said latching post when said base and cover members are in confronting relation, said buckle having a mounting lug receiving aperture and a latching post receiving aperture, each defined by a pair of spaced parallel side rails flanking said post and lug, and by bridging bars joining said rails at their opposite ends and intermediate thereof;

said mounting lug receiving aperture being of relatively narrow, generally rectangular form whose longer sides are formed by said intermediate and one of said end bridging bars, said lug receiving aperture being substantially less wide than the projecting camming surface of said lug but substantially equal to the thickness of said lug between said cooperating recesses, at least one of said end and intermediate bars having resilience transversely in the plane of the buckle;

said latching post receiving aperture being also of generally rectangular form, wherein the portions of said side rails defining the sides of said post aperture provide strap portions flexible transversely of the plane of the buckle, and wherein the bridging bar forming the distal end of said buckle has a resilient catch which releasably engages said latching post detent when said buckle is in latching position.

2. A latch structure as defined in claim 1, wherein said mounting lug and latching post are integrally molded in the confronting edges of said base and cover members.

3. A latch structure as defined in claim 1, wherein said buckle is integrally molded to provide said rails and bridging bars defining said lug and post receiving apertures.

4. A latch structure as defined in claim 1, wherein one of said bars of said buckle defining said lug receiving aperture is formed with an arcuate tab extending into said aperture in the plane of the buckle.

5. A latch structure as defined in claim 4, wherein said arcuate tab is formed on the end bar of said buckle.

6. A latch structure as defined in claim 4, wherein the width of said lug receiving aperture at the peak of said arcuate tab is slightly less than the thickness of the lug between said cooperating recesses.

7. A latch structure as defined in claim 1, wherein at least one of said end and intermediate bars of said buckle defining said lug receiving aperture is slotted lengthwise to impart said transverse resiliency.

* * * * *